US006202798B1

(12) United States Patent
Friedman et al.

(10) Patent No.: US 6,202,798 B1
(45) Date of Patent: Mar. 20, 2001

(54) ELEVATOR ENTRANCE DOOR ASSEMBLY AND METHOD OF INSTALLATION

(76) Inventors: Harold S. Friedman, 15 Poplar Dr., Roslyn, NY (US) 11576; Steven Carosella, 126 Soundview Ave., White Plains, NY (US) 10606; Richard Michalik, 100 Manhattan Ave., Apt 716, Union City, NJ (US) 07087

( * ) Notice: Subject to any disclaimer, the term of this patent is extended or adjusted under 35 U.S.C. 154(b) by 0 days.

(21) Appl. No.: 09/217,005

(22) Filed: Dec. 21, 1998

Related U.S. Application Data

(63) Continuation of application No. 08/869,635, filed on Jun. 5, 1997, now abandoned, which is a continuation-in-part of application No. 08/591,358, filed on Jan. 25, 1996, now Pat. No. 5,673,770.

(51) Int. Cl.[7] ..... B66B 13/06
(52) U.S. Cl. ..... 187/333; 187/325
(58) Field of Search ..... 187/313, 325, 187/333, 324, 334, 414; 52/30, 204.1, 217; 49/116, 120

(56) References Cited

U.S. PATENT DOCUMENTS 3,447,637 * 6/1969 Berkovitz ..... 187/333

OTHER PUBLICATIONS

National Elevator Cab and Door Corp., Mar. 25, 1996.*

Tyler Company, "Elevator Cars, Elevator Entrances," (Cleveland 1927), pp. 10, 11, 18, 19.

National Elevator Cab & Door Corp., "'Secure Slide' The Accessible Elevator Entrance, " (Mar. 25, 1996).

* cited by examiner

*Primary Examiner*—Kenneth W. Noland

(57) ABSTRACT

This invention relates to an improved sliding entrance door assembly for an elevator and to the method of installing the assembly. In one embodiment the assembly includes one or more stationary panels affixed to the frame. The stationary panels are comprised of a side panel and a transom panel. The side panel replaces the wall adjacent to the elevator opening. The transom panel is located above the sliding entry door and the side panel. By using the stationary panel, which is thinner than a conventional wall, the sliding entry door assembly uses less of the hallway space. In an alternate embodiment, two sliding entry doors are installed in the frame. They are in separate planes so that one door can slide behind the other. The advantages to the present door assembly is that it may be installed in less time and the assembly requires less space than conventional door assemblies. Also the assembly closes the gap to the shaftway as soon as it is installed.

16 Claims, 8 Drawing Sheets

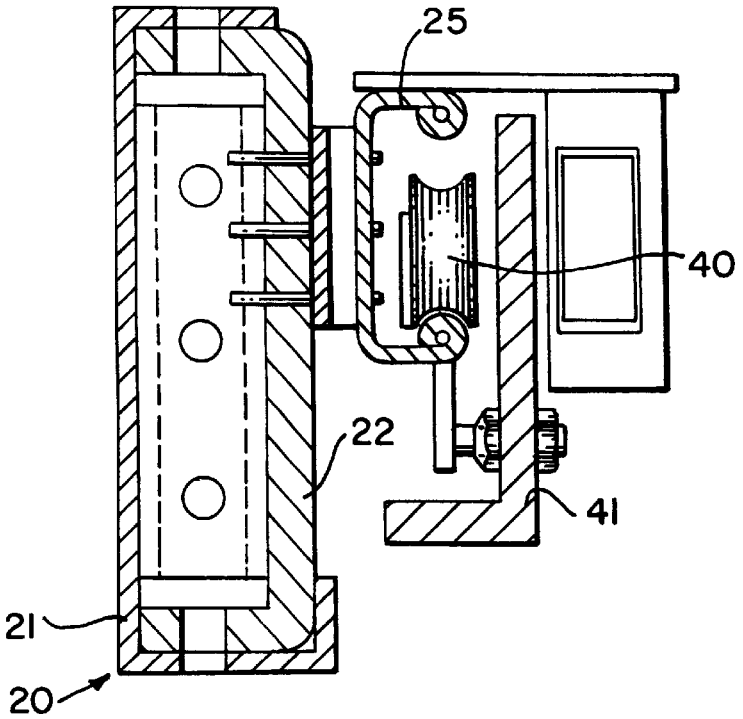
FIG. 6
FIG. 7
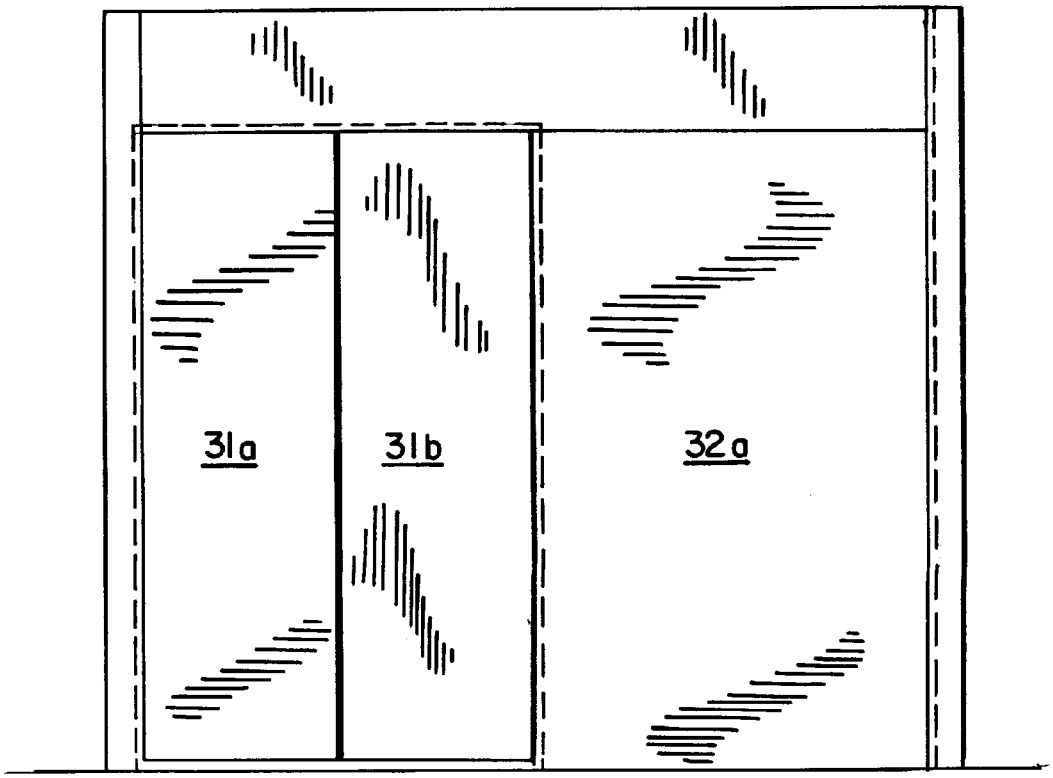

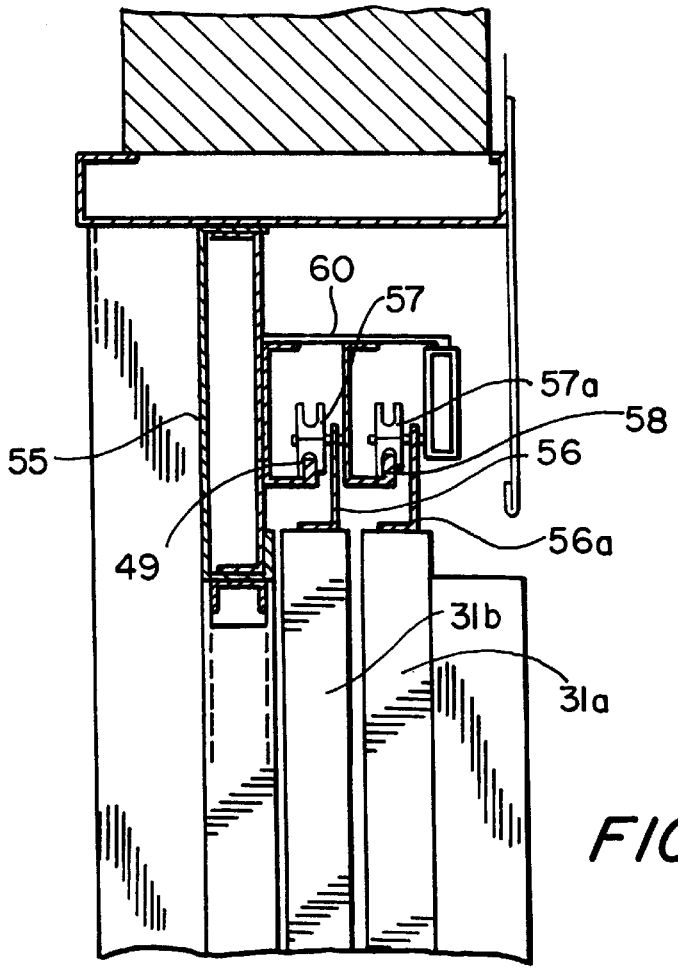
FIG.9
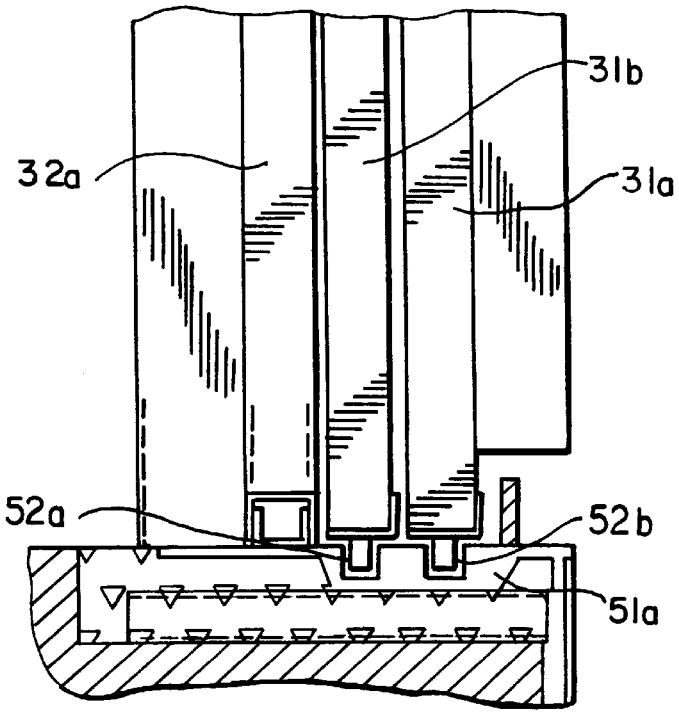

ELEVATOR ENTRANCE DOOR ASSEMBLY AND METHOD OF INSTALLATION

This application is a continuation of application U.S. Ser. No. 08/869,635, filed Jun. 5, 1997 now abandoned, which in turn is a continuation-in-part application and partly discloses and claims subject matter disclosed in earlier filed application, U.S. Ser. No. 08/591,358, filed Jan. 25, 1996 and entitled "Sliding Door Assembly For An Elevator And Method Of Installing Same," now U.S. Pat. No. 5,673,770. A related application is U.S. Ser. No. 09/182,327, filed Oct. 29, 1998, entitled "Sliding Elevator-Door Assembly And Method Of Installation."

FIELD OF THE INVENTION

The present invention relates to building construction and more particularly to a sliding entrance door assembly for an elevator.

BACKGROUND OF THE INVENTION

Two types of elevator entrance assemblies that are commonly used to provide access to elevators are swing entrance doors and sliding entrance doors. Swing entrance doors open by pivoting about a hinge when the door handle is pulled. Sliding entrance doors open by traveling along a linear track in tandem with an elevator cab door. This invention relates to an improved sliding entrance door assembly for an elevator and to the method of installing the improved sliding door assembly, especially in constructing new buildings.

At the present time the construction of a sliding door assembly for elevators is relatively labor intensive, time-consuming, expensive and may present safety hazards. An elevator door entry assembly refers to the frame and sliding door which separates a hallway (corridor) from the elevator shaft (hoistway or shaftway). As the separate door on the elevator cab opens, or closes, it drives the entry door open or closed.

One problem with the installation of an elevator door entry assembly is that there is an opening to the elevator shaft until the entry door is installed, which is almost the last step in the installation procedure. Generally that gap is filled with a temporary barrier, such as a plywood sheet, installed at the site. However, particularly in new construction, the plywood sheet may be carelessly installed, installed late or not covering the entire opening. If tools, loose bolts, etc. should fall down the elevator shaft, they may injure those below.

In addition, the door, and possibly parts of the frame and other components of the entry assembly are generally lifted and installed from the elevator cab or moving platform. The moving platform (work platform) is lifted and lowered in the elevator shaft and is used during construction. That procedure makes the moving platform and elevator shaft unavailable for other work. For example, if it requires two days to install the door, etc. of each entry assembly of an elevator shaft and the building is 20 floors high, the moving platform must be used for 40 work days for installation of entry assemblies on that shaftway. Often the moving platform must be operated by a special, and costly, operator and is required for other construction tasks, which must wait until the moving platform is no longer needed for the installation of entry door assemblies.

SUMMARY OF THE INVENTION

In accordance with the principles of the present invention, the shortcomings of the aforementioned construction method and system have been overcome through a new and improved sliding entry door assembly and installation process. Specifically, it is now possible to construct a sliding entry door assembly for an elevator shaft with minimum noise, dirt, disruption, and delay as well as with greater safety. In one embodiment a sliding entry door assembly includes one or more stationary panels affixed to the frame. The stationary panels are comprised of a side panel and a transom panel. The side panel replaces the wall adjacent to the elevator opening. The transom panel is located above the sliding entry door and the side panel. In its open position, the sliding entry door is positioned behind the stationary side panel. By using the stationary panel, which is thinner than a conventional wall having the same fire rating, the sliding entry door assembly uses less of the hallway space.

In an alternative embodiment of the present invention, two sliding entry doors are installed in the frame. They are in separate planes so that one of the doors can slide behind the other. One of the sliding entry doors slides faster than the other so that both sliding entrance doors complete the slide approximately simultaneously behind the side stationary panel. Another embodiment is of a center opening sliding entry door assembly which includes left and right sliding doors which open from the center to the left and right, respectively. This embodiment may use a left, and a right, stationary panel.

It has now been found that a superior elevator entry door assembly may be constructed according to the present invention. Its main advantage is that the entire assembly, including hanging the door (or doors) may be performed from the hallway. No use is made of the moving platform. This permits the moving platform to be used for other purposes and saves the labor cost of its operation.

Another of its advantages is that the entry door assembly may be installed in a building in less time than conventional elevator entry door assemblies. It is possible to install this new elevator entry door assembly in a single day.

Another advantage of this new door assembly is that it requires less space than conventional elevator entrance door assemblies. It fits within the wall without protruding into the hallway or elevator shaftway (hoistway).

Another advantage is that it closes the gap to the shaftway as soon as it is installed, without a temporary barrier, such as a plywood sheet barrier. In addition, that closure, consisting of the door (or doors) and stationary panel (or panels) has a fireproof rating. That closure of the opening to the shaftway is an important safety feature as it prevents persons and objects from accidentally falling down the shaftway.

This elevator entrance door assembly may be installed either in a new building ("new construction") or as a replacement of an existing entry door ("modernization"). It has a frame having (as viewed from the hallway) a left post, a right post and a top header connecting the left post to the top post. The entry door assemblies, which do not open from the center, also have a center post. A transom panel is located on the top portion of the entrance frame and is fixed to the top side. A stationary side panel is located on one side of the entrance frame and is affixed to the adjacent post and the sill and the transom. The transom and the vertical posts (left, right and center) may be exposed to the hallway. A sliding elevator entrance door slides within the elevator entrance frame. In its open position, the sliding elevator entrance door slides behind the stationary panel.

This assembly requires about three to five fewer inches in space (thickness) than conventional elevator door assemblies Thus, in buildings that have elevators on both sides of a hall, a total of about six to ten inches may be saved on each floor.

Additionally, this elevator entry door assembly is safer to install and provides a safe elevator shaft during construction of a building. It can be installed in a building without leaving the shaft open for an extended period of time. Open shafts pose a great danger because people can fall down the shaftway or objects can fall down the shaft and strike a worker.

To reduce the danger posed by open shafts, conventional elevator door assemblies often require the erection of temporary partitions, such as a sheet of plywood. These partitions take time to erect, are aesthetically undesirable in modernization and, through carelessness, may be omitted. They are not fire rated. The entry door assembly of the present invention completely closes the shaft and provides a fire rating as soon as it is installed.

Finally, the present elevator entrance assembly provides a savings of indirect costs because of reduced field costs, i.e., there is no use made of the moving platform; the assembly is quicker to install; the sequence of trades, i.e., carpenters, electrical workers, etc. is simplified so that it is less costly.

BRIEF DESCRIPTION OF THE DRAWINGS

FIG. 6 is a cross-sectional view of the transom and track of the assembly of FIG. 1;

FIG. 7 is a front view of an entrance door assembly having two sliding doors;

FIG. 9 is a side cross-sectional view of the sliding entrance door assembly having two sliding entrance doors;

DETAILED DESCRIPTION OF THE INVENTION

Figure 1:
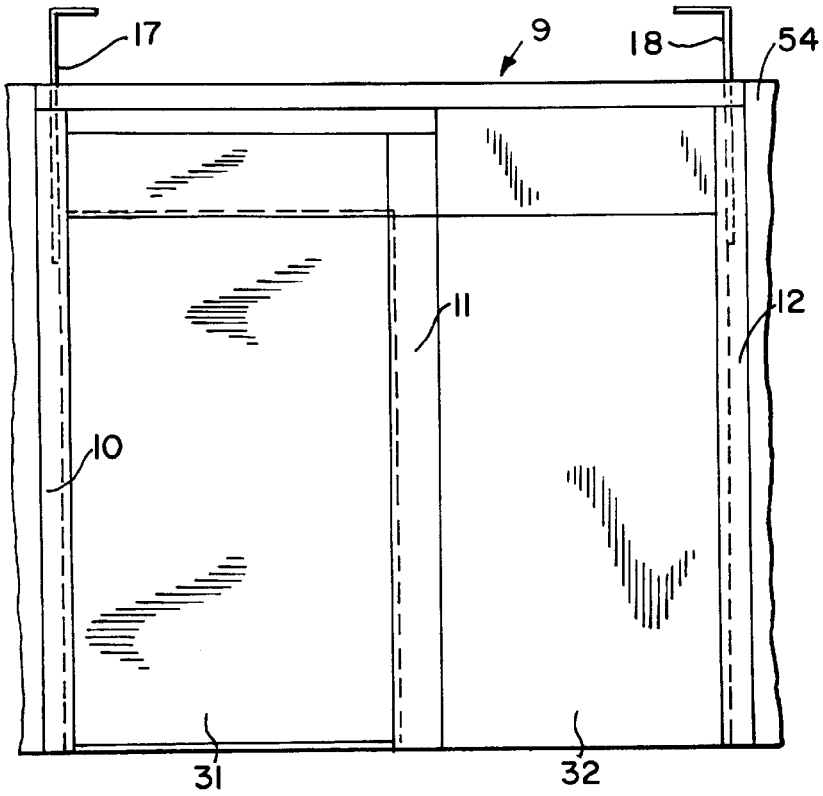
FIG. 1 is a front view of a sliding entrance door assembly of the present invention.

The elevator sliding door assembly of the present invention is built into the wall forming the elevator door opening. Preferably it is thin, with its maximum thickness being 12 inches (30.48 cm) and its preferred thickness being 8 inches (20.32 cm). That is sufficiently thin to fit within conventional-cement block walls, or masonry walls which are 8–12 inches thick or dry wall construction, which is generally 8 inches thick.

The assembly is based on a frame whose parts are pre-cut so that they may be assembled, on site, preferably using nuts and bolts. Alternatively, the entire frame (without the door) may be assembled in a factory, for example, by welding, and transported and erected at the site as a unit. In either case, the entire assembly, including the door, is installed from the hallway (corridor) and not from the elevator shaft (hoistway or shaftway). This presents the advantage that installation of the door does not occupy time from the moving platform (elevator) which may be used on other projects. The moving platform is the work elevator which is lifted and lowered in the elevator shaft during construction. In addition, the hallway presents a base which is stable and readily accessible and may be used without the special safety precautions required when working from a moving platform.

The first embodiment is of a single sliding door entry door assembly. Its frame includes, viewed from the hallway as in FIG. 1, a left post 10 (forming the left boundary of the frame), a center post 11, which is optional, and a right post 12 (forming a right boundary of the frame). The left post 10 is the strike jamb of the elevator entrance; the right post 12 is its rear jamb, and the center post 11 is its return jamb. The center post 11 is attached to the transom 20 and is optional (may be omitted in some installations).

Figure 4:
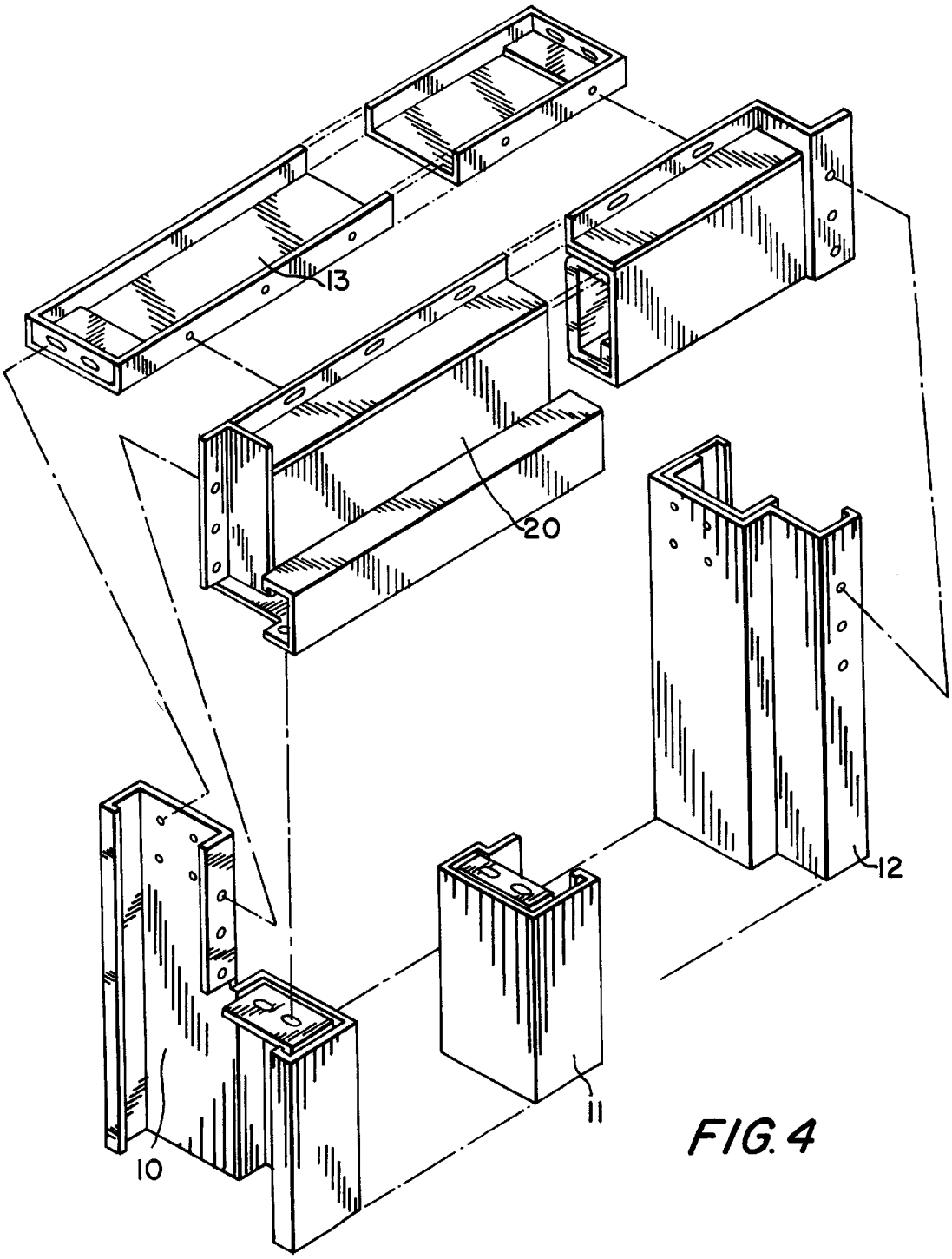
FIGS. 4 and 5 are perspective views of frame members of the assembly of FIG. 1.

A top header 13 is attached to the left post 10 and right post 12 at their top portions, see FIG. 4. Preferably the posts 10–12, as well as header 13 and other frame members, are formed of No. 14 USSG Cold Rolled Furniture Steel. They are formed in a general "U" shape (in cross-section). The posts 10, 11 and 12 are vertical and parallel; the header 13 is horizontal and spans the posts 10, 11 and 12.

Figure 2:
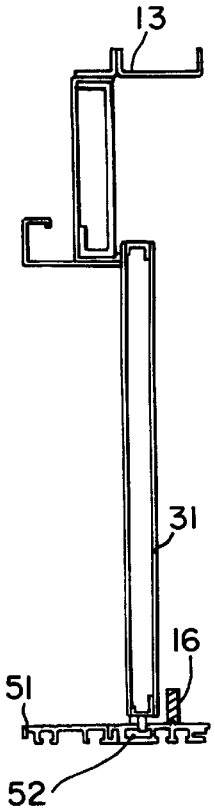
FIG. 2 is a side cross-sectional view of the sliding entrance door assembly of FIG. 1.
Figure 3:
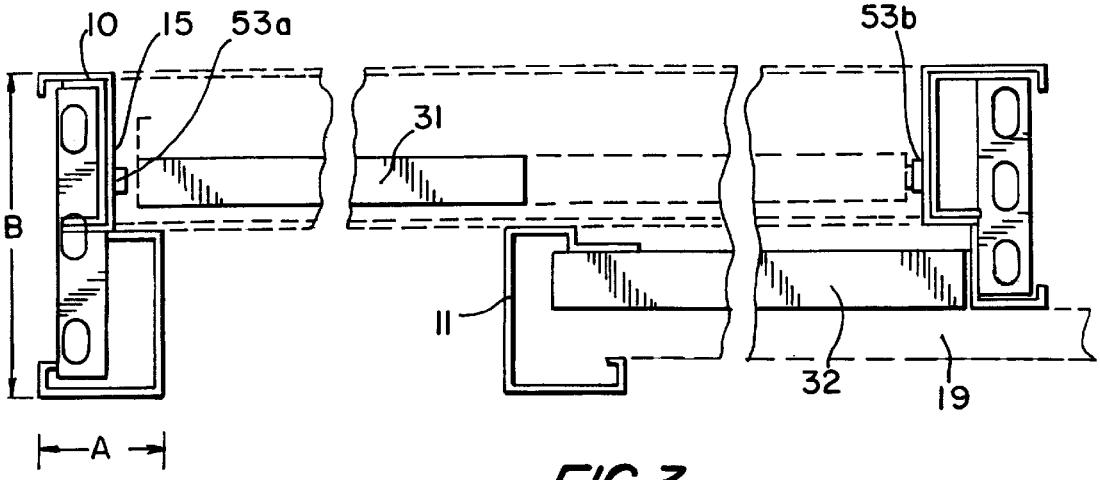
FIG. 3 is a top view of the sliding entrance door assembly of FIG. 1.

As shown in FIG. 3, the left post 10 is preferably 3" inches (7.62 cm) wide—front arrow A; and 8⅛" thick (20.63 cm)—arrow B. It has an indented portion 15 to receive the sliding door. The posts 10–12 would typically be 84" (213.36 cm) in height, although their height depends on the height of the sliding door. Mounted to the frame 9 (door buck) are a left door bumper 53A and a right door bumper 53B to absorb the impact of the sliding entrance door 31. A left door stop 16 and a right door stop (not shown) are mounted to the slide sill 51 (saddle) to prevent the sliding entrance door 33 from being pushed into the elevator car, as shown in FIG. 2. The slide sill 51 is positioned on the floor between the left post 10 and right post 12 of the elevator frame 9. The slide sill 51 is fabricated of metal with a slip resistant surface. The slide sill 51 has a groove which defines a lower track 52 for the sliding entrance door. The stationary panel 32, near the end of construction, may be covered with a conventional dry wall (sheet rock—plaster board) 19, tile, or other decorative covering.

Figure 5:
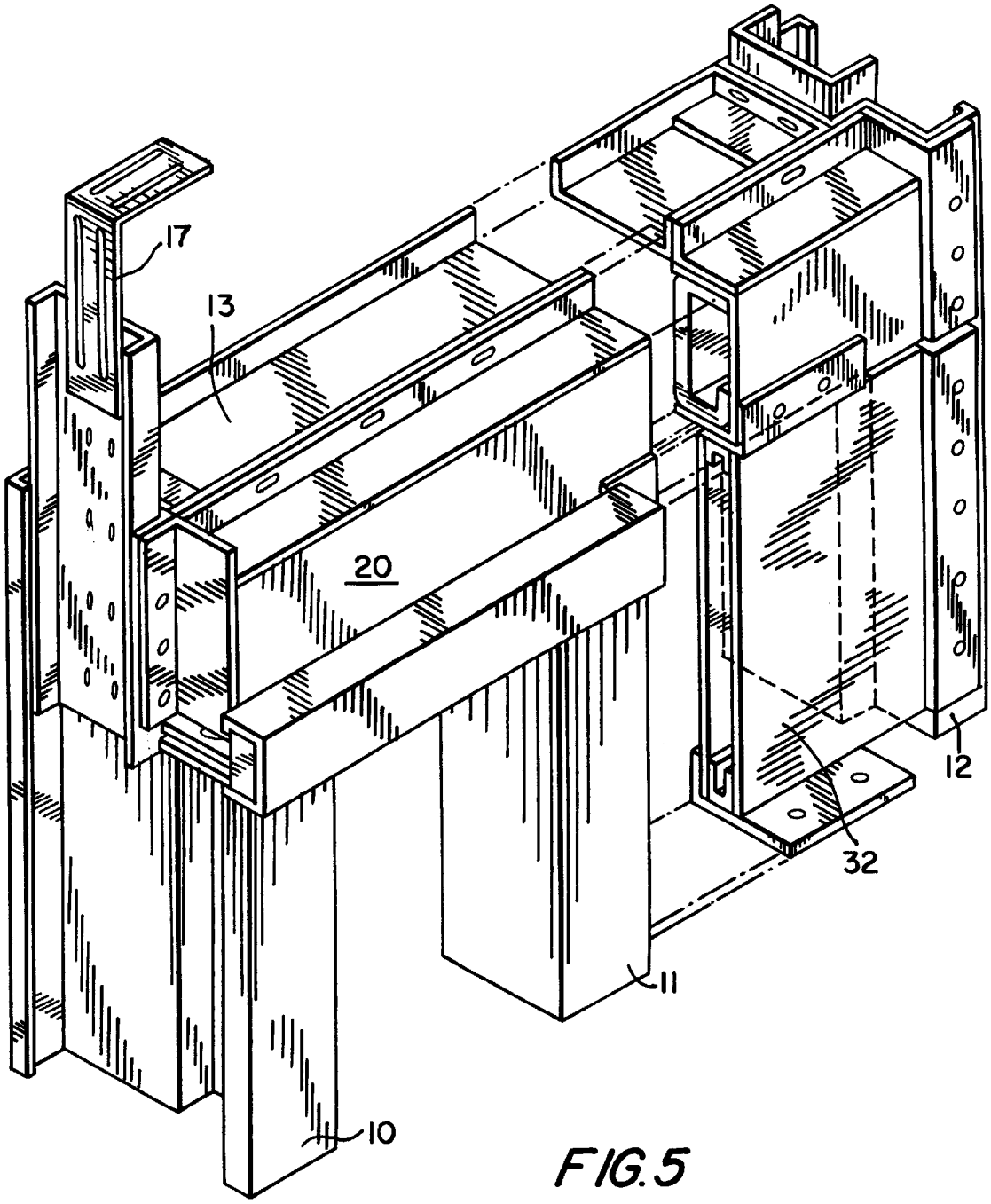

As shown in FIG. 5, which is a view from the front: (the hallway) a transom 20 is bolted to the right post 12 (rear jamb) and the header 13 (head jamb), to the center post 11 (return jamb) and left post 10 (strike jamb), and to the top header 13. An adjustable bracket 17 connects the left post 10 to a cross-beam of the building and a similar adjustable bracket 18 connects the right post 12 to the beam.

As shown in FIG. 6, the transom 20 consists of a front panel 21, preferably 7.5" high (19.05 cm), and a back panel 22, preferably 7⁵⁄₁₆" high (19.37 cm), which fits in the front panel. The front panel 21 is preferably of 16-gauge cold rolled steel and the back panel 22 is preferably of ³⁄₁₆" (0.48 cm) steel. The back panel is of a heavier gauge metal as it supports the track 25. FIG. 6 shows a roller 40 which is attached to the hanger 41 which is bolted to the top of the door 31. The roller 40 rolls on the track 25. Generally the door 31 is suspended by two hangers, each rotatably carrying a roller.

As shown in FIG. 1, a stationary side panel 32 is connected to center post 11 and right post 12 and spans the space between them. That stationary panel, along with the door, closes the shaft during construction. There is a danger, if the elevator shaft is left open during construction, that loose bolts, tools and debris may fall into the shaft and injure workers below.

Figure 12:
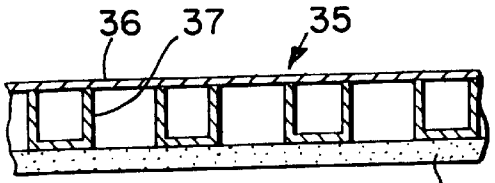
FIGS. 12 and 13 are top cross-sectional views of sections of alternative stationary panels.
Figure 13:
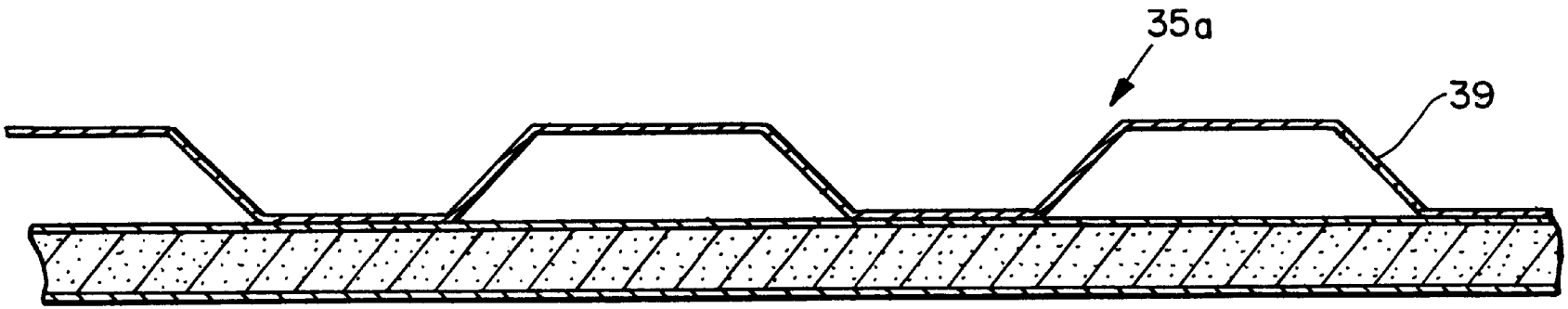

The stationary panel 32 is fire-rated, which means it passes a fire test of the New York City Fire Department. It is preferably sufficiently strong to withstand 1000 pounds per square foot pressure. A suitable stationary panel is 1⅜" or thicker and has front and rear faces of No. 16 or 18 USSG Cold Rolled Furniture Steel, respectively, and internal beam reinforcements. Alternatively, a lighter weight stationary panel may use a cardboard based honeycomb core and steel inner and outer faces. Two alternative side panels 35 are shown in FIGS. 12 and 13. The side panel 35 consists of a back sheet 36 of sheet metal, vertical metal studs 37 and a front face of a conventional sheet rock 38, see FIG. 12. The side panel 35A is a corrugated sheet metal panel 39 which, in effect, has parallel vertical studs, see FIG. 13. The panels 35 and 35A have a front face of dry wall (sheet rock). For example, the studs 37 may be thin, 1–2 inches, in order to provide a thin panel. The dry wall sheet 38 may be one or more sheets in order to provide, along with the studs, a two-hour fire rating. In the embodiment of FIG. 12, the metal sheet 36 is supplied by the factory with the studs 37 welded thereto. The sheet rock is attached to the studs or corrugated sheet, on site. The sliding door 31, in this embodiment, has a fire rating of 1½ hours and has front and rear faces of No. 16 or 18 USSG Cold Rolled Furniture Steel with internal vertical steel reinforcement beams. It is 1⅜" thick or thicker. The door 31 and stationary panel 32 may be painted and may be decorated.

The size of the siding entry door 31 is slightly larger than the opening defined by the transom 20, stationary side panel 32, sill 51 and left post 10, enabling the sliding entrance door to substantially seal the opening.

As shown in FIG. 6, an upper track 25 is mounted on the transom 20 and hangers 41 are mounted on the top of the sliding entrance door 31, enabling the sliding entrance door 31 to travel smoothly in a linear path. Gibs are affixed to the bottom of the sliding entrance door 31 for guiding the sliding door in the groove 52 of the slide sill 51, as shown in FIG. 2.

An interlock is mounted on the transom 20. The interlock prevents the sliding entrance door 31 from opening when it is not positioned adjacent to the elevator car.

The entire erection of the elevator door assembly is preferably accomplished from the hallway (corridor). In new construction the hallway would be a raw (unfinished) concrete slab floor and walls. Typically, the erection of an elevator door assembly required the use, or blocking, of the shaft, thereby posing a difficult scheduling problem. For example, if a building is 20 floors high, and it takes 2 days to erect each elevator door assembly, then the moving platform (work elevator) and shaft (hoistway) would be used for the elevator door assembly construction for 40 days. The moving platform (work elevator) cannot be used, during that time, for other purposes.

The vertical posts 10, 11 and 12, horizontal header 13, transom 20 and track 25 may readily be lifted to the job site and installed using bolts and nuts. Alternatively, the entire frame may be assembled, using welding or bolts and nuts, at the factory, transported to the job site and installed as a unitary assembly. Also the stationary side panel 32 may readily be bolted onto the frame members after they are assembled. However, the elevator door 31 may seem to present a greater problem, since it must be hung from the track 25.

The preferred way to hang the sliding door 31 is as follows. The frame 9 is erected, but without the center post 11. Then temporary safety barriers are placed horizontally at the bottom and center of the frame. The door is prepared with its hangers and rollers installed. The door is placed in the hallway in front of the frame 9 and angled into the shaft with its bottom on the hallway floor and its top at an angle and extending into the shaft. The door is then brought to the vertical so that its rollers are placed within the track (rollable on the track). The door has been hung when the rollers roll on the track and the door is vertical.

The following are some of the alternative methods of hanging the door 31 on the track 25 after the frame is installed:

(A) One end of the transom is hinged and it is otherwise left unconnected. For example, the transom is connected to the left post 10 by a strong hinge and is not connected to the center post 11 or the right post 12. That hinge permits the transom to be swung outwardly into the hallway. The door 31 is hung on the transom while the transom is jutting into the hallway. The transom 20 and door 31 is then swung back into place and the transom 20 secured to the header 13, center post 11 and right post 12.

(B) The entire frame is assembled and laid flat on the hallway floor. At that time the door 31 is hung on the track 25. The frame, along with door 31, is pivoted, placed upright and secured in its intended position.

(C) The rollers 40 and the reverse L-shaped hanger member 41 attached to the rollers 40 are hung on the transom 20 after the transom is assembled to the posts 10–13. The entire frame is assembled. Then the door 31 is fastened to the hangers 41.

After the plumbness of the assembly is inspected, concrete is poured between the elevator frame and the block wall for bonding the elevator frame to the block wall 54.

The description has been of a single sliding elevator door assembly. However, this assembly may be used as a module and combined, preferably at the building site with similar modules, to form pairs of assemblies or entire walls of elevator door assemblies.

Figure 10:
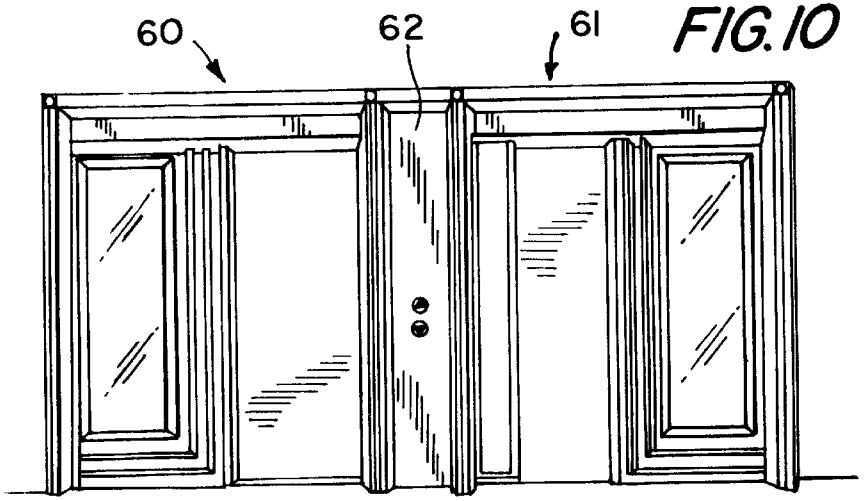
FIG. 10 is a front view of two side-by-side entrance door assemblies.

FIG. 10 shows two elevator sliding door assemblies 60 and 61 each of which is of the same construction as is illustrated in FIGS. 1–6. A panel 62 having buttons (on its front) and electrical controls behind the panel (not shown) is preferably assembled and wired in the factory.

Figure 11:
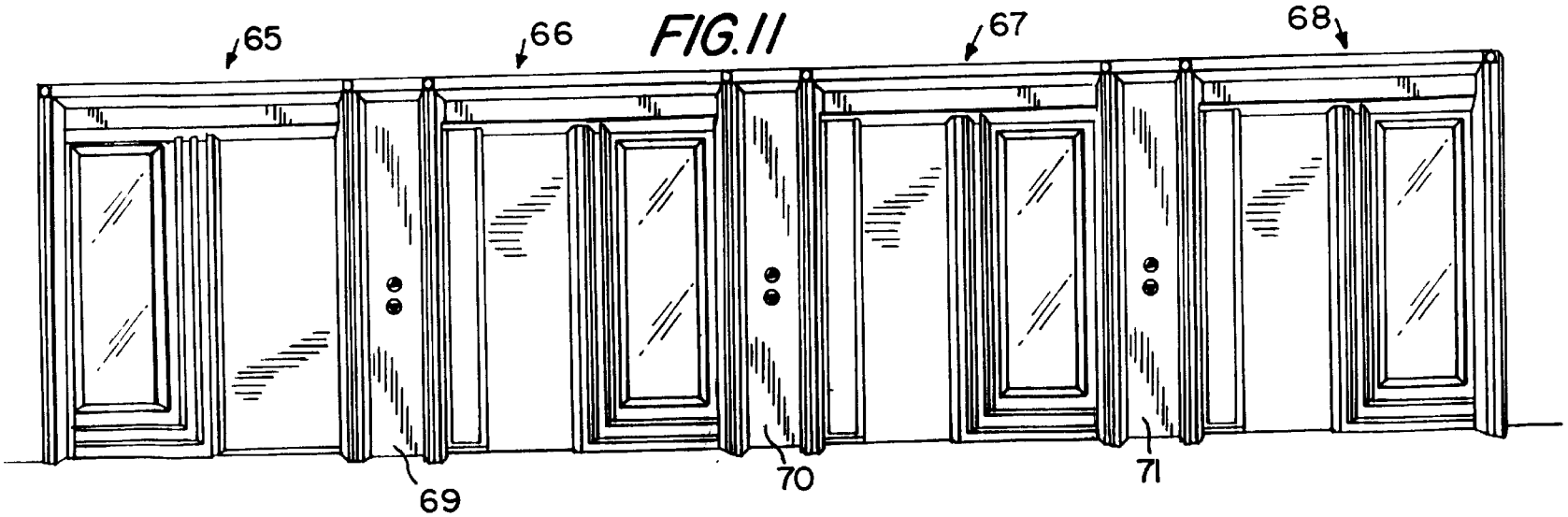
FIG. 11 is a front view of an entire wall comprising four entrance door assemblies.

FIG. 11 shows an entire elevator hall wall formed of four sliding door assemblies 65–68 and panels 69–71. The assemblies are of the type illustrated in FIGS. 1–6 and the panels 69–71 are formed and wired in the factory and then assembled to the frame assemblies on site.

Figure 8:
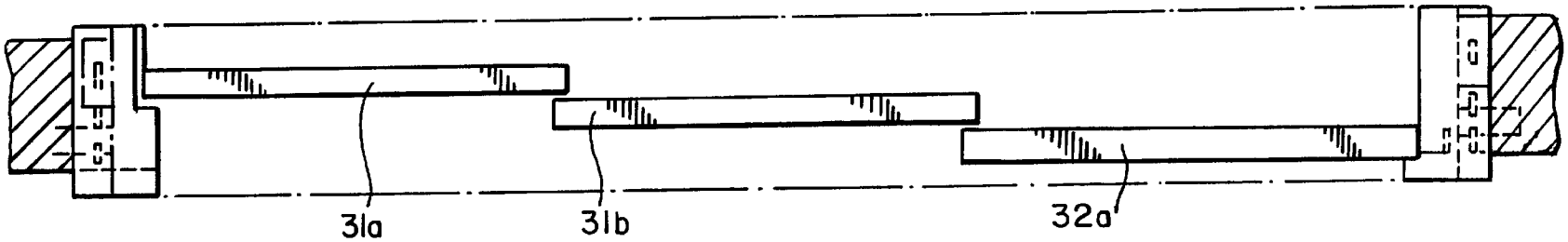
FIG. 8 is a top view of an embodiment of FIG. 7.

FIGS. 7–9 show an alternative embodiment of the present invention, in which two sliding entrance doors are installed in the same frame. The entrance doors are in separate planes so that one of the doors can slide behind the other. One of the sliding entrance doors slides faster than the other so that both sliding entrance doors complete the slide approximately simultaneously behind the side stationary panel.

When the elevator entrance doors open, the sliding entrance doors and the side stationary panel 32*a* line up in three separate planes. Since there are two elevator entrance doors in this embodiment, the side stationary panel can be narrower than the one used in the single door embodiment.

In this embodiment a slide sill 51*a* has two grooves that define two lower tracks 52A, 52B for both entrance doors 31*a* and 31*b*. An upper track 49 is mounted on the transom 55. Hanger 56 and roller 57 are mounted on the top of the sliding entrance door 31*b*. The roller 57 rolls on the upper track 49 enabling the sliding entrance door 31*b* to travel smoothly in a linear path. An upper track 58 is mounted to a brace 60 which is attached to the transom 55. Hanger 56*a* and roller 57*a* are mounted to the top of the left sliding entrance door 31*a*. The roller 57*a* rolls on the upper track 58*a* enabling the sliding entrance door 31*a* to travel smoothly in a linear path. An interlock is mounted on the brace 60. The interlock prevents the sliding entrance door 31*a* and sliding entrance door 31*b* from opening when they are not positioned adjacent to the elevator car.

When the elevator entrance doors open, the sliding entrance door 31*b* slides behind the stationary panel 32*a* and the sliding entrance door 31*a* slides behind the sliding entrance door 31*b*. The sliding entrance door 31*a* slides faster than the sliding entrance door 31*b* so that both doors complete the slide approximately simultaneously.

Alternatively, the present invention may be applied to a center-opening entrance door assembly. In that case the doors open from the center—one to the left and one to the right. Two stationary panels are used, one on the left and one on the right. Two center posts, which are optional, may also be used.

The foregoing description of the invention should be considered as illustrative, and not as limiting. Various changes and modifications will occur to those skilled in the art, without departing from the true scope of the invention as set forth in the following claims.

What is claimed is:

1. An elevator sliding entrance door assembly installed between a hallway and an elevator shaft without protruding into the hallway or shaft; said assembly being installable into an opening in a wall, said wall being located between the hallway and the shaft and having a front face forming a plane and a rear face forming a different plane defining said opening, said assembly comprising, viewed from the hallway:

(a) a left vertical post having a top portion;

(b) a right vertical post having a top portion and positioned parallel to the left post;

(c) a header connected to the left and right posts proximate their top portions;

(d) a transom attached to the header and left post and right post;

(e) an elevator door track attached to the transom;

(f) a sliding elevator door having rolling means to rollingly suspend the door from the track; and (g) a slide sill having a groove therein which defines a lower track for the door, the sill extending between the left post and the right post.

2. An elevator door assembly according to claim 1 wherein the left vertical post and right vertical post have U-shaped portions in cross-section.

3. An elevator door assembly according to claim 1 wherein said assembly also comprises a stationary side panel extending from the hallway floor to the transom and proximate one post; said stationary panel being attached to the transom and the post and the sill occupying about one-half or less of the wall opening and being between the front and rear facing planes of the wall.

4. An elevator door assembly according to claim 3 wherein the stationary side panel has a fireproof rating.

5. An elevator door assembly according to claim 1 wherein the sliding means includes at least two hangers connected to the door and a roller rotatably mounted on each hanger, so that said sliding door can slide across the door track.

6. An elevator sliding entrance door assembly installed between a hallway and an elevator shaft preferably without protruding into the hallway;

(1) a wall located between the hallway and the shaft having a front face forming a plane and a rear face forming a plane and having an opening therethrough;

(2) the assembly being no more than 9 inches thick, and being installed in the wall opening and between the planes of the wall; the assembly comprising, viewed form the hallway:

(a) a left vertical post having a top portion;

(b) a right vertical post having a top portion and positioned parallel to the left post;

(c) a header connected proximate the top portions of the left and right posts;

(d) a transom attached to the header, left post and right post;

(e) an elevator door track attached to the transom;

(f) an elevator door having a rolling means to rollingly suspend the door from the track; and (g) a slide sill having a groove therein which defines a lower track for the door, the sill extending between the left post and the right post.

7. An elevator door assembly according to claim 6 wherein said assembly also comprises a stationary panel extending from the hallway floor to the transom and proximate one post, said stationary panel occupying at least one-third of the wall opening.

8. An elevator door assembly according to claim 7 wherein the stationary panel has a fireproof rating.

9. An elevator door assembly according to claim 6 wherein each sliding means includes at least two hangers connected to each door and a roller rotatably mounted on each hanger, so that said door can roll across the door tracks.

10. A wall comprising a plurality of side-by-side elevator sliding entrance door assemblies installed between a hallway and an elevator shaft preferably without protruding into the hallway and, viewed from the hallway, each door assembly comprising:

(a) a left vertical post having a top portion;

(b) a right vertical post having a top portion and positioned parallel to the left post;

(c) a header connected proximate the top portions of the left and right posts;

(d) a transom attached to the header;

(e) an elevator door track attached to the transom;

(f) an elevator door having sliding means to slidingly suspend the door from the track; and (g) a slide sill having a groove therein which defines a lower track for the door, the sill extending between the left post and the right post.

11. A wall according to claim 10 and each assembly also comprising a stationary panel extending from the hallway floor to the transom and proximate one post; the stationary panel occupying at least one-third of the wall opening.

12. A wall according to claim 11 wherein the stationary panel has a fireproof rating.

13. A wall according to claim 10 wherein the sliding means includes at least two hangers connected to the door and a roller rotatably mounted on each hanger, wherein the rollers roll on the door track.

14. The method of installing an elevator sliding entrance door assembly in a building under construction without using a moving platform, in which the assembly is installed between a hallway and an elevator shaft preferably without protruding into the hallway and which closes off the shaft during construction; the assembly being assembled from the hallway and viewed from the hallway, the steps of the method comprising:

(a) installing a sill in the hallway and proximate the shaft, the sill having a groove therein which defines a lower track;

(b) installing a left vertical post having a top portion;

(c) installing a right vertical post having a top portion and positioned parallel to the left post;

(d) connecting a top header to the left and right posts proximate their top portions;

(e) attaching a transom to the top header;

(f) attaching an elevator door track to the transom;

(g) lifting an elevator door from the hallway, and not from a moving platform, and suspending the elevator door from the track so that it slides on the door track and slides within the sill groove.

15. The method of claim 14 and also installing a stationary side panel by attaching the side panel to one post and the sill transom, the side panel descending from the transom to the hallway floor level.

16. The method of claim 14 and also providing a wall in a plane of the frame assembly, said entrance door assembly being between the imaginary planes of the inner and outer faces of the wall so that the entrance door assembly preferably does not extend into the hallway.

* * * * *